US012310494B2

(12) United States Patent
Hornbacher

(10) Patent No.: US 12,310,494 B2
(45) Date of Patent: May 27, 2025

(54) FREESTANDING LADDER STORAGE RACK

(71) Applicant: Michael D. Hornbacher, Elkhorn, NE (US)

(72) Inventor: Michael D. Hornbacher, Elkhorn, NE (US)

( * ) Notice: Subject to any disclaimer, the term of this patent is extended or adjusted under 35 U.S.C. 154(b) by 0 days.

(21) Appl. No.: 18/465,957

(22) Filed: Sep. 12, 2023

(65) Prior Publication Data

US 2023/0413995 A1 Dec. 28, 2023

Related U.S. Application Data

(63) Continuation-in-part of application No. 29/775,614, filed on Mar. 24, 2021, now Pat. No. Des. 998,389,
(Continued)

(51) Int. Cl.
*A47B 57/48* (2006.01)
*A47B 47/02* (2006.01)
(Continued)

(52) U.S. Cl.
CPC ..... *A47B 57/487* (2013.01); *A47B 47/022* (2013.01); *A47B 57/52* (2013.01);
(Continued)

(58) Field of Classification Search
CPC ..... A47B 87/0207; A47B 87/0276; A47B 57/487; A47B 57/42; A47B 81/005;
(Continued)

(56) References Cited

U.S. PATENT DOCUMENTS 1,380,570 A * 6/1921 Lehman ..... A47B 81/005 211/60.1
1,698,974 A * 1/1929 Vance ..... A47B 81/005 D6/672

(Continued)

FOREIGN PATENT DOCUMENTS

CN 108354357 8/2018
CN 208821991 5/2019

(Continued)

OTHER PUBLICATIONS

Uline, https://www.uline.com/Product/Detail/H-3846/Bar-and-Pipe-Storage-Racks/Cantilever-Rack-Single-Sided-80-x-40-x-96?pricode=WA9625&gadtype=pla&id=H-3846&gclsrc=aw.ds&&gclid=CjwKCAiAyeTxBRBvEiwAuM8dnfEUmUwkyd4lYgT6nKexvpObrdgwJY3H--M2ggtPS5JEn6nU5wZthRoCWUoQAvD_BWE.

(Continued)

*Primary Examiner* — Jennifer E. Novosad
(74) *Attorney, Agent, or Firm* — McGrath North Mullin & Kratz, PC LLO; Luke C. Holst

(57) ABSTRACT

Racks for storing elongated objects, such as ladders, lumber, and/or piping, and more specifically, to a freestanding ladder storage rack that may utilized individually or in a series to store objects of varying lengths, sizes, and kinds. A purpose of the invention is to provide an improved storage rack that is adjustable in length and height to provide for optimal storage capacity. In an exemplary embodiment, the storage rack may comprise a plurality of cantilevered, elongated arms having a closed first end removably secured to a vertical frame and an opposite open second end for placing objects thereon. In some instances, the storage rack may include at least one shelf and/or a table accessory when used in series. The plurality of arms, at least one shelf, and table
(Continued)

may be adjustable in height along the vertical frame of the storage rack depending on requirements of an operator.

18 Claims, 6 Drawing Sheets

Related U.S. Application Data which is a continuation-in-part of application No. 29/752,077, filed on Sep. 24, 2020, now Pat. No. Des. 923,367.

(51) Int. Cl.
*A47B 57/52* (2006.01)
*A47B 81/00* (2006.01)
*A47B 87/02* (2006.01)
*A47F 5/10* (2006.01)

(52) U.S. Cl.
CPC ..... *A47B 81/005* (2013.01); *A47B 87/0207* (2013.01); *A47F 5/103* (2013.01)

(58) Field of Classification Search
CPC . A47B 47/022; A47B 96/027; A47B 47/0091; A47F 5/103
USPC ..... 211/191, 150, 103, 193, 194
See application file for complete search history.

(56) References Cited

U.S. PATENT DOCUMENTS

D116,797 S 9/1939 Erickson et al.
D139,415 S 11/1944 Brown et al.
2,626,061 A 1/1953 Girouard
3,164,255 A * 1/1965 Jay ..... A47B 81/005 211/60.1
3,172,539 A 3/1965 Rulf
3,182,812 A * 5/1965 Fenwick ..... A47B 96/1466 211/187
3,212,648 A * 10/1965 Baker, Jr. ..... A47B 57/50 108/108
3,371,798 A 3/1968 D Altrui
3,484,810 A 12/1969 Boss
3,512,654 A * 5/1970 Jay ..... A47B 96/145 411/356
3,602,374 A * 8/1971 Alabaster ..... A47B 57/485 211/193
D222,366 S 10/1971 Berger et al.
3,640,389 A * 2/1972 Snyder ..... A47F 5/0093 211/187
3,913,498 A 10/1975 Hall et al.
D243,906 S 4/1977 Ware
4,023,684 A * 5/1977 Saul ..... A47F 5/10 211/193
D247,034 S 1/1978 Brodmann
D252,779 S 9/1979 Mogelhoj
D253,450 S 11/1979 Butcher et al.
D255,405 S 6/1980 De Villers
4,286,719 A 9/1981 Hall
D269,754 S 7/1983 Kates
4,396,125 A 8/1983 Rowader
D272,400 S 1/1984 Persch
4,426,011 A * 1/1984 Jay ..... A47B 96/061 211/193
4,519,512 A 5/1985 Frazier et al.
4,552,270 A 11/1985 Lentz et al.
D282,611 S 2/1986 Seely
D288,509 S * 3/1987 van de Oudeweetering . D6/708
4,646,656 A * 3/1987 Marschak ..... A47F 5/103 108/108
4,657,149 A * 4/1987 Masson ..... A47F 5/105 211/198
D291,164 S 8/1987 Luyk et al.
4,776,469 A * 10/1988 Geleziunas ..... A47J 47/16 211/41.11
4,776,472 A * 10/1988 Rosen ..... A47B 96/025 211/175
4,819,814 A * 4/1989 Fogelgren ..... A47F 7/146 312/107
4,895,381 A * 1/1990 Farlow ..... B62B 3/02 211/208
D313,715 S 1/1991 Ohno
5,076,651 A 12/1991 White
5,272,991 A * 12/1993 Carrigan, Jr. ..... A47B 96/067 211/188
5,285,906 A 2/1994 Wisnowski
5,303,830 A * 4/1994 Metcalf ..... A47F 5/0807 211/208
D347,129 S 5/1994 Zinke
5,310,066 A 5/1994 Konstant
D356,907 S 4/1995 Jernigan
5,433,327 A * 7/1995 Benvenuti ..... A47B 91/00 211/187
D369,040 S 4/1996 Lechleiter et al.
D370,370 S 6/1996 Brown
D377,428 S 1/1997 Rossdeutscher
D383,335 S 9/1997 Shanahan et al.
D389,657 S 1/1998 Sigal
D390,724 S 2/1998 Parker et al.
D392,820 S 3/1998 Shanahan et al.
D395,769 S 7/1998 Reeves
5,806,691 A 9/1998 Nelson
5,833,079 A 11/1998 Roberts
5,875,905 A * 3/1999 Gretencord ..... E04C 3/086 211/183
5,890,607 A * 4/1999 Maglione ..... A47F 5/0846 108/108
5,894,946 A * 4/1999 Darnell ..... A47F 5/0018 211/183
5,918,432 A * 7/1999 Mahone ..... A47B 47/00 52/36.5
5,918,750 A * 7/1999 Jackson ..... A47F 5/0807 108/108
D419,349 S 1/2000 Klein et al.
6,059,126 A * 5/2000 Miller ..... B65B 67/1227 211/85.15
6,089,387 A * 7/2000 Varfolomeeva ..... A47F 5/0031 211/90.03
6,112,913 A * 9/2000 Rindoks ..... A47B 57/30 312/247
6,129,224 A * 10/2000 Mingers ..... A47B 57/482 211/192
6,138,841 A 10/2000 Klein et al.
6,164,465 A 12/2000 Schroeder
6,175,498 B1 1/2001 Conroy et al.
6,216,887 B1 4/2001 Soo
6,260,865 B1 7/2001 Yacobi et al.
D455,916 S 4/2002 Fluhrer
6,390,309 B1 5/2002 Tucker
D480,350 S 10/2003 Ho
D492,862 S 7/2004 Gay, II
D495,531 S 9/2004 Allshouse et al.
D499,672 S 12/2004 Thompson
D505,572 S 5/2005 Chang
7,178,681 B2 * 2/2007 Libman ..... A47F 5/0815 211/90.03
7,204,377 B2 * 4/2007 Marion ..... F16B 7/0426 211/183
7,213,713 B2 5/2007 Matsui
D557,543 S 12/2007 Hanson
D557,544 S 12/2007 Mashinske
D560,402 S 1/2008 Lev
7,314,143 B1 * 1/2008 Johnson ..... A47B 57/487 211/106
D569,656 S 5/2008 Musick
D580,193 S 11/2008 Sparkowski
D601,841 S 10/2009 Neufeld
D608,115 S 1/2010 Trinn
D633,313 S 3/2011 Ma
D640,485 S 6/2011 Dugger

(56) References Cited

U.S. PATENT DOCUMENTS

| | | | | |
|---|---|---|---|---|
| 8,016,137 | B2 * | 9/2011 | Shaha | A47B 96/1408 248/200 |
| 8,042,229 | B2 | 10/2011 | Wang | |
| 8,172,098 | B2 * | 5/2012 | Eustace | A47B 57/22 211/189 |
| 8,221,297 | B2 | 7/2012 | Faust | |
| D668,476 | S | 10/2012 | Carlshamre | |
| 8,333,158 | B2 * | 12/2012 | Wise | A47B 57/20 108/134 |
| D692,261 | S | 10/2013 | Sharp | |
| 8,550,259 | B1 * | 10/2013 | McCoy | H02G 3/30 211/13.1 |
| D692,701 | S | 11/2013 | Peggs | |
| 8,579,127 | B2 * | 11/2013 | Dyck | A47B 96/068 211/103 |
| D713,877 | S | 9/2014 | Kuehn | |
| D716,080 | S | 10/2014 | Bell | |
| D720,164 | S | 12/2014 | Parrish | |
| 8,959,813 | B2 * | 2/2015 | Denby | G09F 15/0068 40/606.03 |
| D729,554 | S | 5/2015 | Denby et al. | |
| D730,663 | S | 6/2015 | Logan | |
| 9,044,090 | B2 * | 6/2015 | Drake | A47B 96/061 |
| D745,794 | S | 12/2015 | Knoll et al. | |
| D752,372 | S | 3/2016 | Huff | |
| D776,956 | S | 1/2017 | Ma | |
| D781,080 | S | 3/2017 | Jordan et al. | |
| D785,381 | S | 5/2017 | Johnson | |
| D786,581 | S | 5/2017 | Lien | |
| 9,669,907 | B2 | 6/2017 | Field | |
| 9,774,134 | B2 * | 9/2017 | Bonner | A47F 5/0815 |
| D805,329 | S | 12/2017 | Rockwell | |
| D809,324 | S | 2/2018 | Robins | |
| 9,936,825 | B1 * | 4/2018 | Lindblom | A47F 5/0087 |
| 10,004,330 | B1 | 6/2018 | Kasza | |
| 10,039,379 | B1 | 8/2018 | Phillips et al. | |
| D833,782 | S | 11/2018 | Amacher, Jr. | |
| 10,118,678 | B2 | 11/2018 | Dias | |
| D840,729 | S | 2/2019 | Irek | |
| D842,014 | S | 3/2019 | Qui et al. | |
| 10,264,878 | B1 | 4/2019 | Liu | |
| D851,429 | S | 6/2019 | Greenspon | |
| D853,762 | S | 7/2019 | Tucker | |
| D862,137 | S | 10/2019 | Amrine et al. | |
| D862,946 | S | 10/2019 | Hyland | |
| D878,832 | S | 3/2020 | Cohen | |
| D882,286 | S | 4/2020 | Zoretic | |
| D885,800 | S | 6/2020 | Mills | |
| D909,104 | S | 2/2021 | Lai | |
| D910,351 | S | 2/2021 | Davis | |
| D910,958 | S * | 2/2021 | Hokanson | D34/28 |
| D918,627 | S | 5/2021 | Perrotti, Jr. | |
| 10,993,553 | B2 * | 5/2021 | Drew | A47B 96/07 |
| D923,367 | S * | 6/2021 | Hornbacher | D6/672 |
| D923,370 | S | 6/2021 | Davis | |
| D941,619 | S | 1/2022 | Davis | |
| D945,802 | S | 3/2022 | Bell | |
| 11,266,255 | B1 | 3/2022 | Johnson | |
| D970,932 | S | 11/2022 | Zhao | |
| D998,389 | S * | 9/2023 | Hornbacher | D6/672 |
| 2003/0178382 | A1 | 9/2003 | Tucker | |
| 2005/0016943 | A1 * | 1/2005 | Dick | A47F 5/0815 211/189 |
| 2005/0087505 | A1 * | 4/2005 | Lukas | G11B 33/0461 211/41.12 |
| 2005/0194331 | A1 * | 9/2005 | Chang | A63D 15/10 211/60.1 |
| 2006/0254995 | A1 | 11/2006 | Steffens | |
| 2011/0198305 | A1 | 8/2011 | Geoffrey | |
| 2011/0278245 | A1 | 11/2011 | Noble | |
| 2011/0284485 | A1 * | 11/2011 | Sparkowski | A47F 5/103 29/428 |
| 2013/0032553 | A1 * | 2/2013 | Magrini | A47F 5/103 211/42 |
| 2014/0041407 | A1 | 2/2014 | Bush | |
| 2014/0103000 | A1 | 4/2014 | Avissar | |
| 2015/0083679 | A1 * | 3/2015 | Meers | A47F 5/0025 211/74 |
| 2015/0230632 | A1 * | 8/2015 | Cantwell | A47F 5/0807 211/124 |
| 2016/0201844 | A1 | 7/2016 | Potter | |
| 2016/0249996 | A1 | 9/2016 | Gerstner et al. | |
| 2017/0220987 | A1 | 8/2017 | Sun | |
| 2018/0092470 | A1 | 4/2018 | Johnson | |
| 2018/0125264 | A1 | 5/2018 | Amrine et al. | |
| 2018/0271281 | A1 | 9/2018 | Bryan | |
| 2020/0093288 | A1 | 3/2020 | Sun | |
| 2022/0139272 | A1 | 5/2022 | Santarelli | |
| 2022/0379814 | A1 | 12/2022 | Roumeliotis | |
| 2023/0413995 | A1 * | 12/2023 | Hornbacher | A47B 57/487 |
| 2024/0065458 | A1 * | 2/2024 | Pryor | A47F 5/0087 |

FOREIGN PATENT DOCUMENTS

| | | |
|---|---|---|
| CN | 109846217 | 6/2019 |
| FR | 2651654 | 3/1991 |
| GB | 2197183 | 5/1988 |
| GB | 2214413 | 4/1991 |

OTHER PUBLICATIONS

Arms for Series 2000 Medium-Heavy Cantilever Racks, http://materialhandlingsolutions.theonlinecatalog.com/products/arms-for-series-2000-medium-heavy-duty-cantiliver-racks/h2sa12l/?gclid=CjwKCAiAgc-ABhA7EiwAjev-j0_iKRnlWKDiHEcw2fGZMDaZYNMT8w5PrXH30IGG8wMediJDAgSaUxoC0eYQAvD_BwE (Year: 2020).

* cited by examiner

FREESTANDING LADDER STORAGE RACK

CROSS REFERENCE TO RELATED APPLICATIONS

This application is a Continuation in-part of U.S. patent application Ser. No. 29/775,614 filed Mar. 24, 2021, which is a Continuation in-part of U.S. patent application Ser. No. 29/752,077 filed Sep. 24, 2020, herein incorporated by reference in their entirety.

FIELD OF THE INVENTION

The present invention relates in general to racks for storing elongated objects, including but not limited to, ladders, lumber, and/or piping. More specifically, the purpose of the invention is to provide a freestanding ladder storage rack that can utilized individually or in series to store objects of varying lengths, sizes and kinds.

BACKGROUND OF THE INVENTION

Storage racks are often utilized in the construction and agriculture industries to store a variety of elongated objects, including but not limited to, ladders, lumber, and/or piping. Such storage racks typically have three requirements: (i) stability; (ii) an efficient use of space; and (iii) convenience. To satisfy the first requirement, traditional storage racks are often wall-mounted to an interior wall of a facility, such as a warehouse, machine shed, or workshop. Other times or in addition thereto, traditional storage racks may rely upon interlocking cross-pieces that improve the strength and stability of the device during operation. While such customary techniques may satisfy the first requirement of stability, however, they often sacrifice the second and third requirements of efficiency and convenience, respectively.

For instance, traditional wall-mounted storage racks are often permanently or semi-permanently secured to the interior wall of a facility. Such permanent or semi-permanent securement may therefore prevent an entire side of the facility from being used for other purposes, which results in an inefficient use of space. If interlocking cross-pieces are utilized by the storage rack, problems also abound. Not only is the overall footprint size of the storage rack expanded, moreover, the storage rack may be incapable of being conveniently and quickly disassembled and moved if/when the need arises. Such traditional storage racks also lack the adjustability to fit varying lengths, sizes, and kinds of objects, thus limiting the use of the rack to certain sized objects. Traditional storage racks therefore have deficiencies in space-efficiency, adjustability, and convenient portability that leave much to be desired.

Thus what is needed is an improved storage rack that may be used to reliably support and store a variety of elongated objects, including but not limited to, ladders, lumber, and/or piping. What is further needed is an improved storage rack that fulfills each and every requirement of: (i) stability; (ii) an efficient use of space; and (iii) convenience. What is still further needed is an improved storage rack that is freestanding to avoid having to permanently, semi-permanently, or temporarily secure the device to an interior wall of a facility to provide for a more efficient use of space. What is also needed is an improved storage rack that does not require the use of interlocking cross-pieces to provide for convenient portability if/when the need arises. What is additionally needed is an improved storage rack that is adjustable in length and height to fit varying lengths, sizes and kinds of objects to provide for optimal storage capacity.

SUMMARY OF THE INVENTION

The present disclosure solves the aforementioned issues by providing an improved freestanding ladder storage rack that fulfills each and every requirement of: (i) stability; (ii) an efficient use of space; and (iii) convenience. In essence, the storage rack includes a vertical frame connected to a base frame to form an overall framework. A plurality of arms may be removably connected to the vertical frame, wherein the arms are designed to support objects thereon for storage purposes. Each arm may include a closed first end removably secured to the vertical frame and an opposite open second end for placing objects thereon. The arms may be adjustable in height along the vertical frame depending on requirements of the operator. The storage rack is freestanding without securement to a wall of a facility to provide for portability and space efficiency. The storage rack may be used independently or in series with at least one additional storage rack to store objects of varying lengths, sizes, and kinds.

In other instances, the present disclosure solves the aforementioned issues by providing a method of storing objects. In essence, the method may include providing the freestanding ladder storage rack of the present disclosure along with objects to be stored. The method may further include placing the storage rack adjacent to an interior wall of a facility without securing the rack to the wall. Additional storage racks may also be placed adjacent to the interior wall of the facility to create a series of storage racks. Because each storage rack is portable, the distance between each storage rack in series may be adjusted depending on the requirements of the operator. Likewise the height of each arm on the storage racks may also be adjusted. In some instances, arms of each storage rack in series may be positioned at a uniform height to provide support to objects stored across the series of storage racks. Finally, the objects may be placed on the arms of the storage racks for storage purposes.

Principal Objects and Advantages of the Invention

Therefore, it is a principal object, feature, and/or advantage of the present disclosure to overcome the aforementioned deficiencies in the art and provide an improved storage rack that may be used to reliably support and store a variety of elongated objects, including but not limited to, ladders, lumber, and/or piping.

Another object, feature, and/or advantage of the present disclosure is to provide an improved storage rack that fulfills each and every requirement of: (i) stability; (ii) an efficient use of space; and (iii) convenience.

Yet another object, feature, and/or advantage of the present disclosure is to provide an improved storage rack that is freestanding to avoid having to permanently, semi-permanently, or temporarily secure the device to an interior wall of a facility to provide for a more efficient use of space.

A further object, feature, and/or advantage of the present disclosure is to provide an improved storage rack that does not require the use of interlocking cross-pieces to provide for convenient portability if/when the need arises.

A still further object, feature, and/or advantage of the present disclosure is to provide an improved storage rack that is adjustable in length and height to fit varying lengths, sizes, and kinds of objects to provide for optimal storage capacity.

Another object, feature, and/or advantage of the present disclosure is to provide an improved storage that is inexpensive to manufacture, convenient to use, and comprised of lightweight and durable materials.

Other objects, features, and advantages of this disclosure will become apparent from the following description taken in conjunction with the accompanying drawings wherein are set forth, by way of illustration and example and without limitation, certain aspects of this disclosure. The present disclosure is not to be limited to or by these objects, features, and advantages. No single aspect need provide each and every object, feature, or advantage. The scope of the present disclosure is intended to cover all such embodiments that may fall within the scope of the appended claims, either literally or under the doctrine of equivalents.

BRIEF DESCRIPTION OF THE DRAWING FIGURES

FIG. 1 is a front perspective view of the freestanding ladder storage rack with a shelf in an upright position;

FIG. 2 is a front perspective view of the freestanding ladder storage rack of FIG. 1 with the shelf in a downward position;

FIG. 3 is a front view of the freestanding ladder storage rack of FIG. 1;

FIG. 4 is a rear view of the freestanding ladder storage rack of FIG. 1;

FIG. 5 is a left side view of the freestanding ladder storage rack of FIG. 1;

FIG. 6 is a right side view of the freestanding ladder storage rack of FIG. 1;

FIG. 7 is a front perspective view of a series of freestanding ladder storage racks of FIG. 1 holding ladders, boxes, and piping; and FIG. 8 is a front perspective view of a series of freestanding ladder storage racks of FIG. 1 having a table.

DETAILED DESCRIPTION OF THE INVENTION

Referring generally to FIGS. 1-8, the present disclosure is directed to a freestanding ladder storage rack 10 (hereinafter, the "storage rack") for storing elongated objects, including but not limited to, ladders, lumber, and/or piping. The storage rack 10 is designed to be freestanding to avoid having to permanently, semi-permanently, or temporarily secure the device to an interior wall of a facility, such as a warehouse, machine shed, or workshop (hereinafter, the "facility"), to provide for a more efficient use of space. While certain aspects of the present disclosure are shown and described herein, it is understood that such aspects are merely exemplary. The present disclosure is not intended to be limited to these specific aspects and may encompass other aspects or embodiments. Therefore, specific structural and functional details disclosed herein are not to be interpreted or inferred as limiting, but merely as a basis for the claims and as a representative basis for teaching one skilled in the art how to make and use the disclosed subject matter.

It must be noted that the singular terms "a," "an," and "the" as used herein may include plural referents unless the context clearly dictates otherwise. As used herein, in particular aspects, the terms "about" or "approximately" when preceding a numerical value indicates the value plus or minus a range of 0.1, 0.2, 0.3, 0.4 or 0.5 inch. In other aspects, the terms "about" or "approximately" when preceding a numerical value indicates the value plus or minus a range of 0.6, 0.7, 0.8, 0.9, or 1 inch. In still further aspects, the terms "about" or "approximately" when preceding a numerical value indicates the value plus or minus a range of 1, 2, 3, 4, or 5 inches. In additional aspects, the terms "about" or "approximately" when preceding a numerical value indicates the value plus or minus a range of 6, 7, 8, 9, or 10 inches. Furthermore the transitional phrase "comprising" that is synonymous with "including," "containing," and "characterized by" as used herein is inclusive or open-ended and does not exclude additional, unrecited elements, steps or ingredients. Alternatively the transitional phrase "consisting of" as used herein is closed and excludes any element, step or ingredient not specified. The term "generally" as used herein is defined as being mostly but not necessarily wholly that which is specified. The term "larger" as used herein is defined as exceeding most other things of like kind especially in size. The term "smaller" as used herein is defined as having a comparatively little size or slight dimensions.

Figure 1:
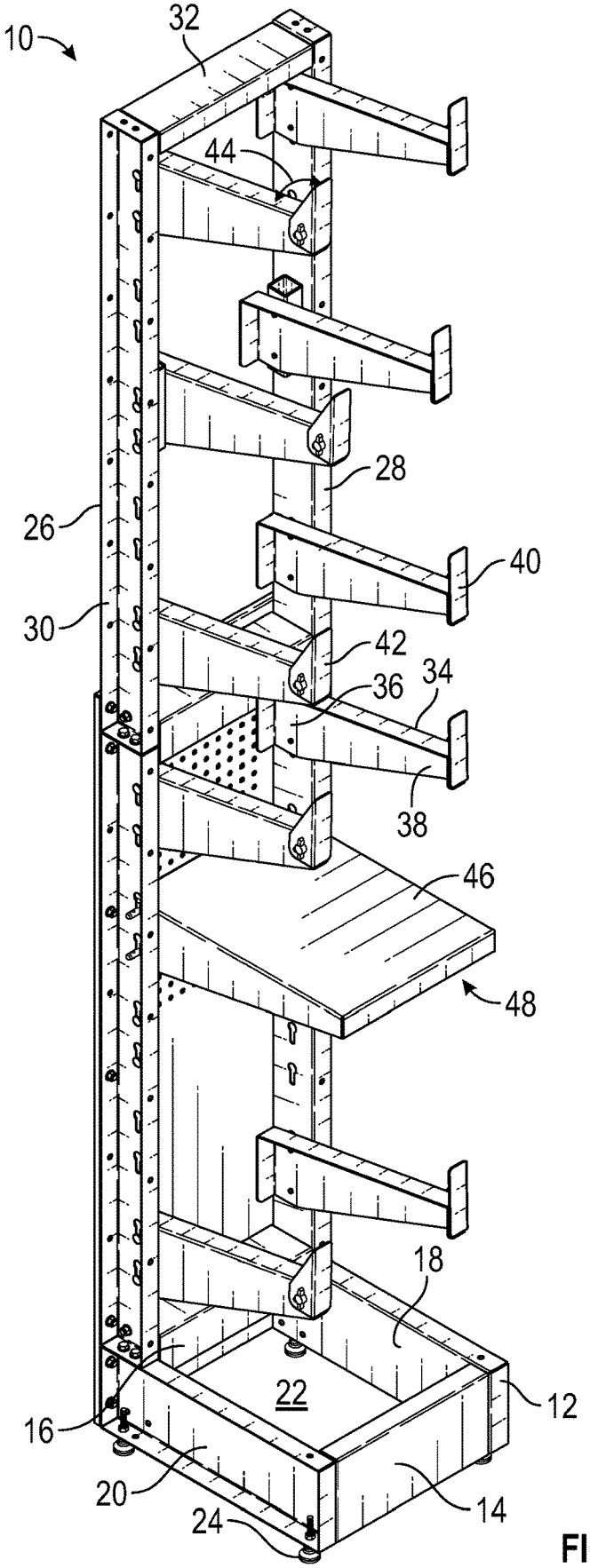
FIGS. 1-8 represent examples of the freestanding ladder storage rack of the present disclosure.
Figure 2:
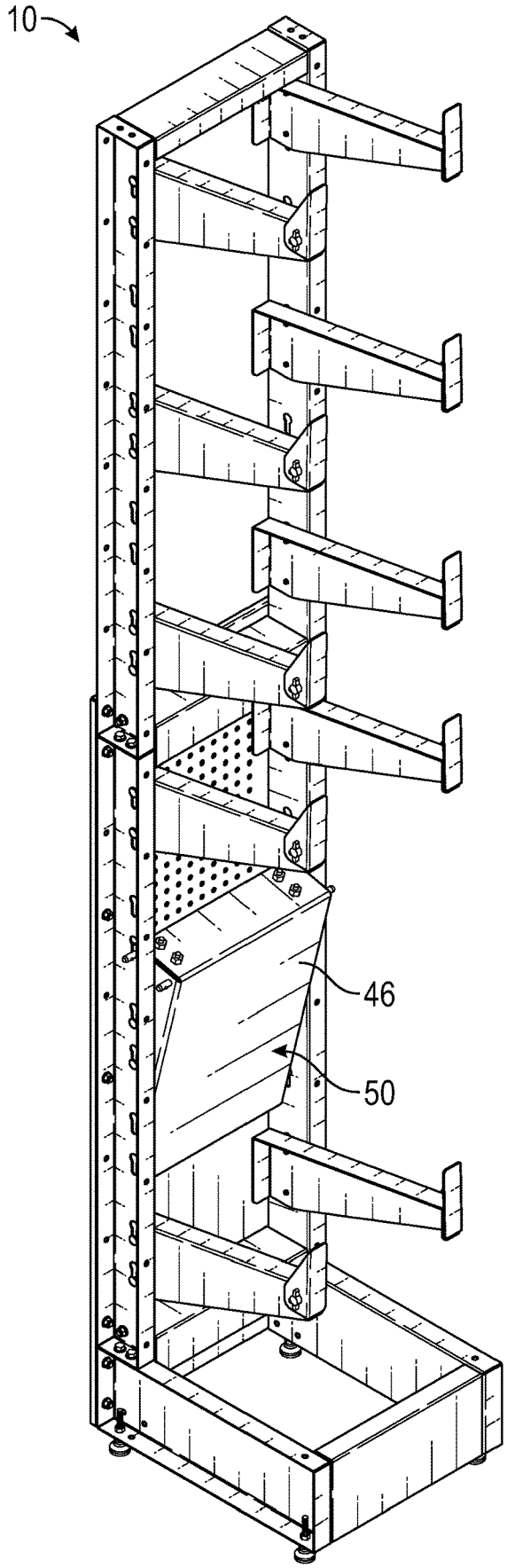

FIGS. 1-2 illustrate a front perspective view of the storage rack 10. The storage rack 10 may comprise a base frame 12 having a front horizontal member 14, an opposite rear horizontal member 16, a left side horizontal member 18, and a right side horizontal member 20. The front, rear, left side, and right side horizontal members 14, 16, 18, 20 may be formed integrally together in the manufacturing process, or alternatively, formed separately and thereafter attached together using, e.g., welds, adhesives, nuts/bolts, and/or screws. After the front, rear, left side, and right side horizontal members 14, 16, 18, 20 are attached together, the base frame 12 may comprise a generally rectangular or square shape having dimensions of approximately 14-24 inches in length, approximately 14-24 inches in width, approximately 4-12 inches in height, and having a thickness of approximately 1.5-3 inches.

In some instances, the front horizontal member 14 of the base frame 12 may include an advertisement panel (not shown) attached to a forward-facing exterior surface of the front horizontal member 14. The advertisement panel is designed for placing a logo thereon for commercial purposes by the manufacturer, and may comprise slightly larger dimensions than the front horizontal member 14. In other instances, the advertisement panel may simply comprise the forward-facing exterior surface of the front horizontal member 14 for placing a manufacturer's logo thereon.

Shown in FIGS. 1-2, the front, rear, left side, and right side horizontal members 14, 16, 18, 20 may form a cubicle 22 positioned inside the base frame 12. In some instances, the cubicle 22 may be open towards the top and bottom of the base frame 12. In this manner, the cubicle 22 may be utilized to store additional materials, such as but not limited to, an open box or closed container for holding smaller objects. Such a box or container may be placed through the open top of the cubicle 22 to rest upon a floor of the facility. In other instances, the cubicle 22 may include a closed bottom surface to act as a receptacle for holding smaller objects placed in storage (not shown).

In some instances, the base frame 12 may further include at least four height adjustment knobs 24. The height adjustment knobs 24 may be positioned on a bottom surface of each corner of the base frame 12. Each height adjustment knob 24 may be independently height adjustable to assist with leveling the storage rack 10 on uneven surfaces. In other instances, the base frame 12 may not include the at least four height adjustment knobs 24, wherein the base frame 12 simply rests upon a floor of the facility.

Further shown in FIGS. 1-2, the storage rack 10 may comprise a vertical frame 26 having a left side vertical member 28 and an opposite right side vertical member 30. The left and right side vertical members 28, 30 may be connected by a top horizontal member 32. The left side vertical member 28, right side vertical member 30, and top horizontal member 32 may be formed integrally together in the manufacturing process, or alternatively, formed separately and thereafter attached together using, e.g., welds, adhesives, nuts/bolts, and/or screws. After the left side vertical member 28, right side vertical member 30, and top horizontal member 32 are attached together, the vertical frame 26 may comprise a generally rectangular shape having dimensions of approximately 4-6 inches in length, approximately 14-24 inches in width, approximately 3.5-12 feet in height, and having a thickness of approximately 1.5-3 inches.

The vertical frame 26 may be connected to a top surface of the base frame 12 to form an overall framework for the storage rack 10. The vertical frame 26 and the base frame 12 may be formed integrally together in the manufacturing process, or alternatively, formed separately and thereafter attached together using, e.g., welds, adhesives, nuts/bolts, and/or screws, to form the overall framework. The vertical frame 26 and the base frame 12 may be formed of lightweight, durable materials such as, but not limited to, stainless steel, wood, plastics, metal, aluminum, or similar materials.

Still further shown in FIGS. 1-2, the storage rack 10 may comprise a series of cantilevered, elongated arms 34 designed to support objects thereon for storage purposes. Each arm 34 may include a closed first end 36 removably secured to either the left side or the right side vertical members 28, 30 and an opposite, open second end 38. The arms 34 may comprise a generally triangular shape of approximately 16-36 inches in length, approximately 1.5-3 inches in width, and having a height that tapers from approximately 2-3 inches at the open second end 38 to approximately 4-6 inches at the closed first end 36. In some instances, at least one pair of arms 34 may be removably secured to the vertical frame 26 in parallel, wherein a first arm 34 may be removably secured to the left side vertical member 28 and a second arm 34 removably secured to the right side vertical member 30 at heights equidistant on the vertical frame 26. Each parallel pair of arms 34 are designed to extend forward to reliably support and store a variety of elongated objects thereon, including but not limited to, ladders, lumber, and/or piping. In other instances, a single arm 34 may be removably secured to the vertical frame 26 and utilized to hang other kinds of objects thereon for storage purposes, such as but not limited to, ropes, electrical cords, and chains. The arms 34 may be arranged equidistant from one another vertically on the left side or right side vertical members 28, 30, or alternatively, may be arranged at unequal distances to fit a particular length, size, and kind of object to be stored. The arms 34 may be formed of lightweight, durable materials such as, but not limited to, stainless steel, wood, plastics, metal, aluminum, or similar materials.

In some instances, certain arms 34 may include a fixed end cap 40 rigidly secured to the open second end 38. In other instances, certain arms 14 may include an adjustable end cap 42 rotatably coupled to the open second end 38. In further instances, each parallel pair of arms 34 may include both a fixed end cap 40 and an adjustable end cap 42. The fixed end cap 40 is designed to prevent an object from unintentionally falling off the arm 34 and injuring an operator thereunder. The adjustable end cap 42 is designed to permit an operator to increase or decrease a stop angle 44. The stop angle 44 may be movable between a sharper incline to prevent an object from unintentionally falling off the arm 34 and a reduced incline to provide for easier placement on or removal of objects from the arm 34 without sacrificing the safety of the operator from unintentional falls.

Shown in FIGS. 1, 2, the storage rack 10 may further include a least one shelf 46 removably secured to the left side and right side vertical members 28, 30 of the vertical frame 26. The shelf 46 is configured to transition into two positions, namely, an upright position 48 as depicted in FIG. 1 and a downward position 50 as depicted in FIG. 2. In particular, the upright position 48 of the shelf 46 may be utilized to store additional materials for quick access, such as but not limited to, an open box or closed container for holding smaller objects placed in storage. When not in use, the shelf 46 may be transitioned to the downward position 50 to provide additional space for objects either suspended from arms 34 above or supported by arms 34 below the shelf 46.

Figure 3:
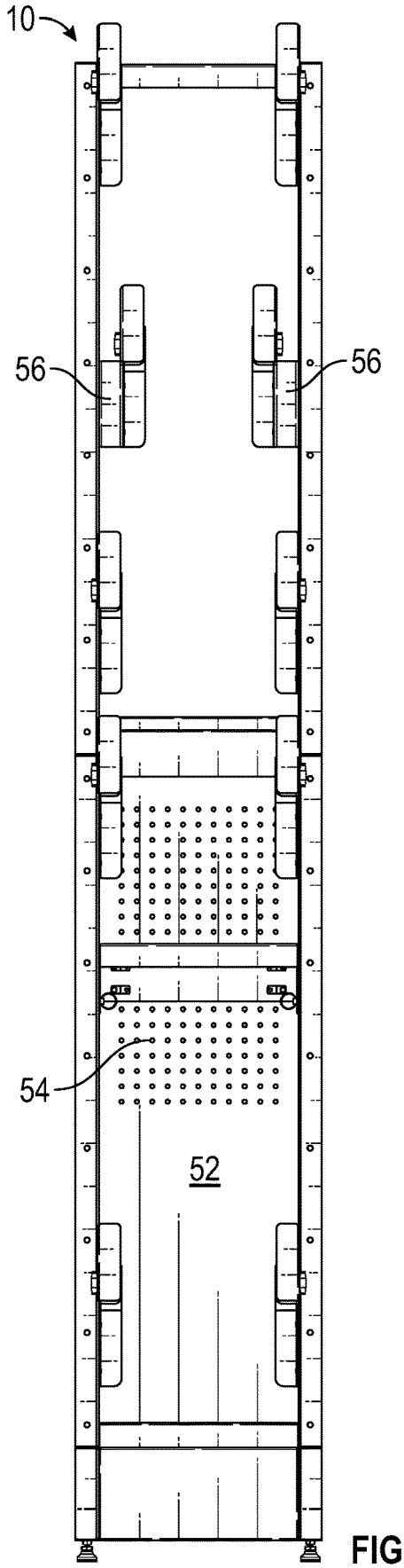
Figure 4:
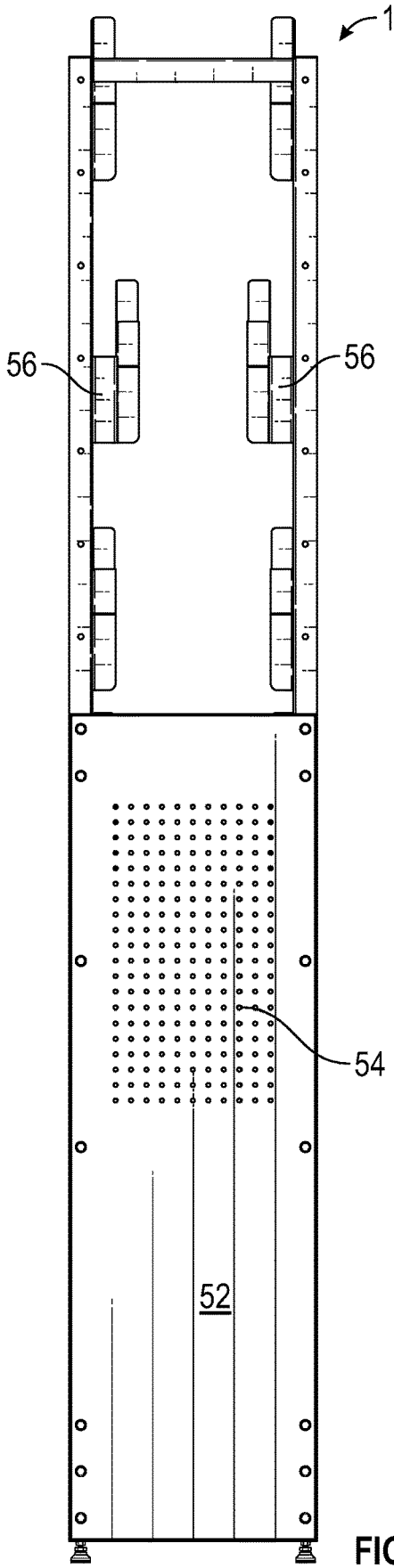

FIG. 3 illustrates a front view of the storage rack 10. FIG. 4 illustrates a rear view of the storage rack 10. Shown in FIGS. 3-4, the storage rack 10 may include a peg board 52 attached to the rear of the base frame 12 and vertical frame 26 using, e.g., welds, adhesives, nuts/bolts, and/or screws. The peg board 52 is configured to provide additional structural support to the overall frame of the storage rack 10 to prevent bending or twisting of the frame while storing heavy loads. The peg board 52 may further include a series of evenly spaced perforated holes 54 designed to accept hooks and hanging bins for mounting, storing and accessing tool accessories. The peg board 52 may be formed of lightweight, durable materials such as, but not limited to, stainless steel, wood, fiberboard, plastics, metal, aluminum, or similar materials.

Further shown in FIGS. 3-4, the storage rack 10 may also include at least one spacer 56. The spacer 56 is designed for an arm 34 to be removably secured to a first side of spacer 56, wherein an opposite second side of spacer 56 may be removably secured to the left side or right side vertical members 28, 30 of the vertical frame 26. Spacers 56 may be utilized with the present disclosure to shorten the distance between a pair of arms 34 removably secured to the vertical frame 26 in parallel. Such adjustability in distance provides for optimal support when storing smaller elongated objects. The spacer 56 may comprise a tubular shape, being either a hollow or solid tube, wherein the tubular shape may comprise square, round, or rectangular. The spacer 56 may also be of approximately the same height, length, and width of the closed first end 36 of arm 34, and formed of the same materials.

Figure 5:
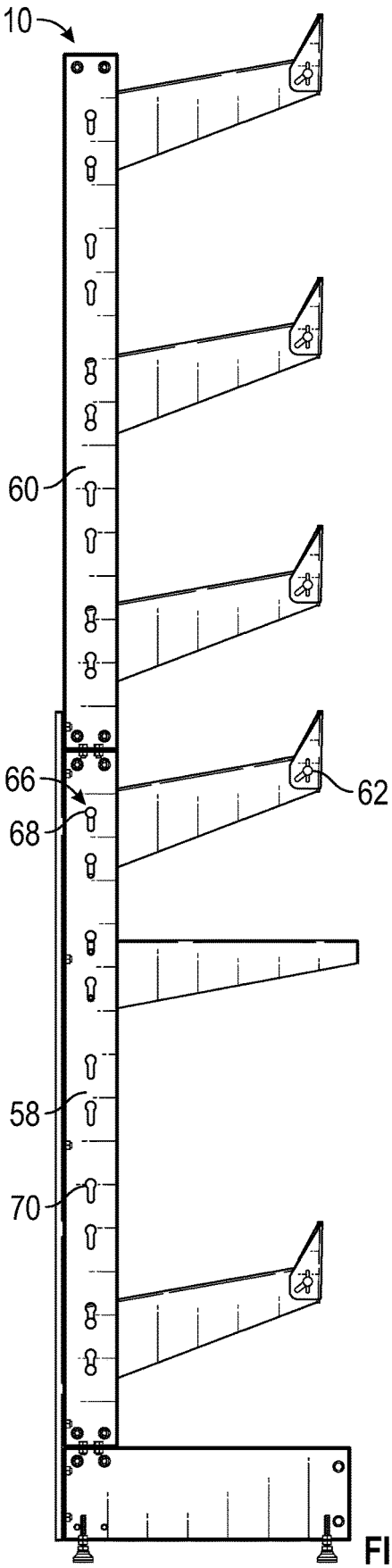
Figure 6:
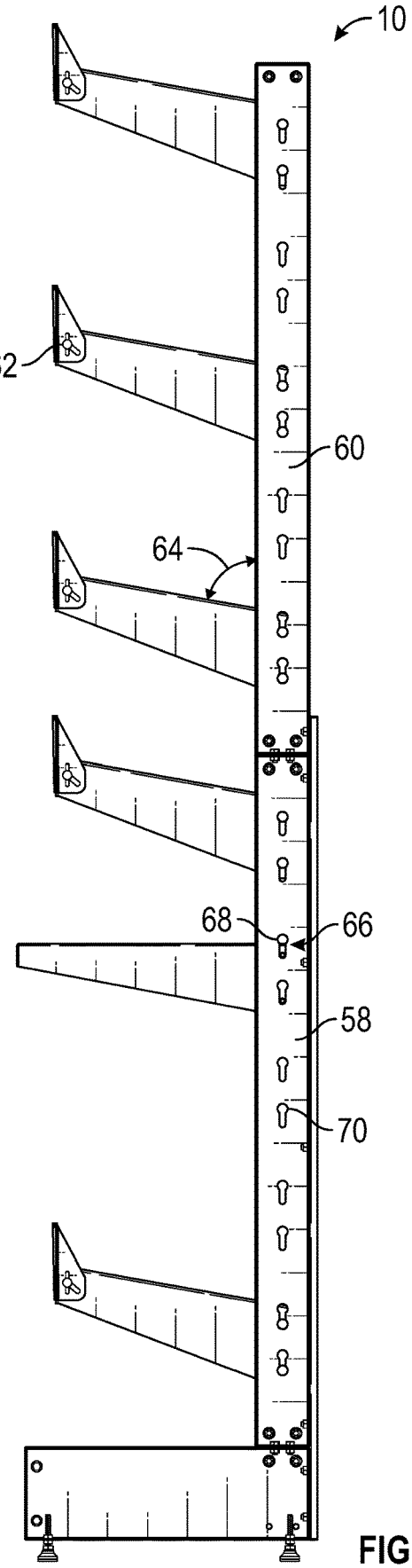

FIG. 5 illustrates a left side view of the storage rack 10. FIG. 6 illustrates a right side view of the storage rack 10. Shown in FIGS. 5-6, the left side and right side vertical members 28, 30 of the vertical frame 26 may each comprise a first section 58 and a second section 60 approximately equal in size and removably secured end-to-end using, e.g., nuts/bolts or screws to provide for convenience in transport and shipping. However, it is also contemplated by the present disclosure that alternatively the left side and right side vertical members 28, 30 of the vertical frame 26 may each comprise a single section to provide for convenience in manufacture and assembly. Further shown in FIGS. 5-6, the adjustable end cap 42 may include an axle and/or wingnuts 62 that rotatably couple the adjustable end cap 42 to the open second end 38 of the arm 34. Such rotatable coupling is designed to permit an operator to increase or decrease the stop angle 44 to provide for easier placement or removal of objects over the open second end 38 of the arm 34.

Still further shown in FIGS. 5-6, the second end 38 of each arm 34 of the storage rack 10 may remain open to allow for an operator to conveniently place objects thereon by sliding the object over the open second end 38 in a horizontal direction towards the rear of the storage rack 10. To facilitate placement of objects thereon and to avoid forward tipping of the storage rack 10 during operation, each arm 34 may slope downwardly from the open second end 38 towards the closed first end 36, wherein such objects may abut against the vertical frame 26 to restrict movement of the object on the storage rack 10. For example, the closed first end 36 of the arm 34 may form an angle 64 of approximately 75-85° with the left side or right side vertical members 28, 30. Conversely, the object may be removed from the arm 34 by sliding the object in a horizontal direction towards the front of the storage rack 10 and off the open second end 38 of the arm 34.

Also shown in FIGS. 5-6, the arms 34 may be removably secured to an interior side of either the left side or right side vertical members 28, 30 using at least one attachment mechanism 66. Alternatively, the arms 34 may be removably secured to the first side of spacers 56, wherein an opposite second side of spacers 56 may be removably secured to the interior side of either the left side or right side vertical members 28, 30 using at least one attachment mechanism 66. Similarly, the shelf 46 may be removably secured to the interior side of both the left side and right side vertical members 28, 30 using at least one attachment mechanism 66. As an exemplary and non-limiting example, the attachment mechanism 66 may comprise a round pin 68 having a head, a shank, and a shank end. The shank end may be integrally formed with or fixedly secured to the respective arm 34, spacer 56, or shelf 46 using, e.g., welds or adhesives. The shank head is designed to removably fit inside and rotatably lock within a series of keyhole slots 70 spaced equidistant along a length of the left side or right side vertical members 28, 30. The series of keyhole slots 70 allow for height adjustability when removably attaching the arms 34 and shelf 46 to the left side and right side vertical members 28, 30 using attachment mechanisms 66. The attachment mechanisms 66 may be integrally formed with or fixedly secured to the respective arms 34, shelves 46, and spacers 56 using, e.g., welds or adhesives, and may further be comprised of the same types of materials.

Figure 7:
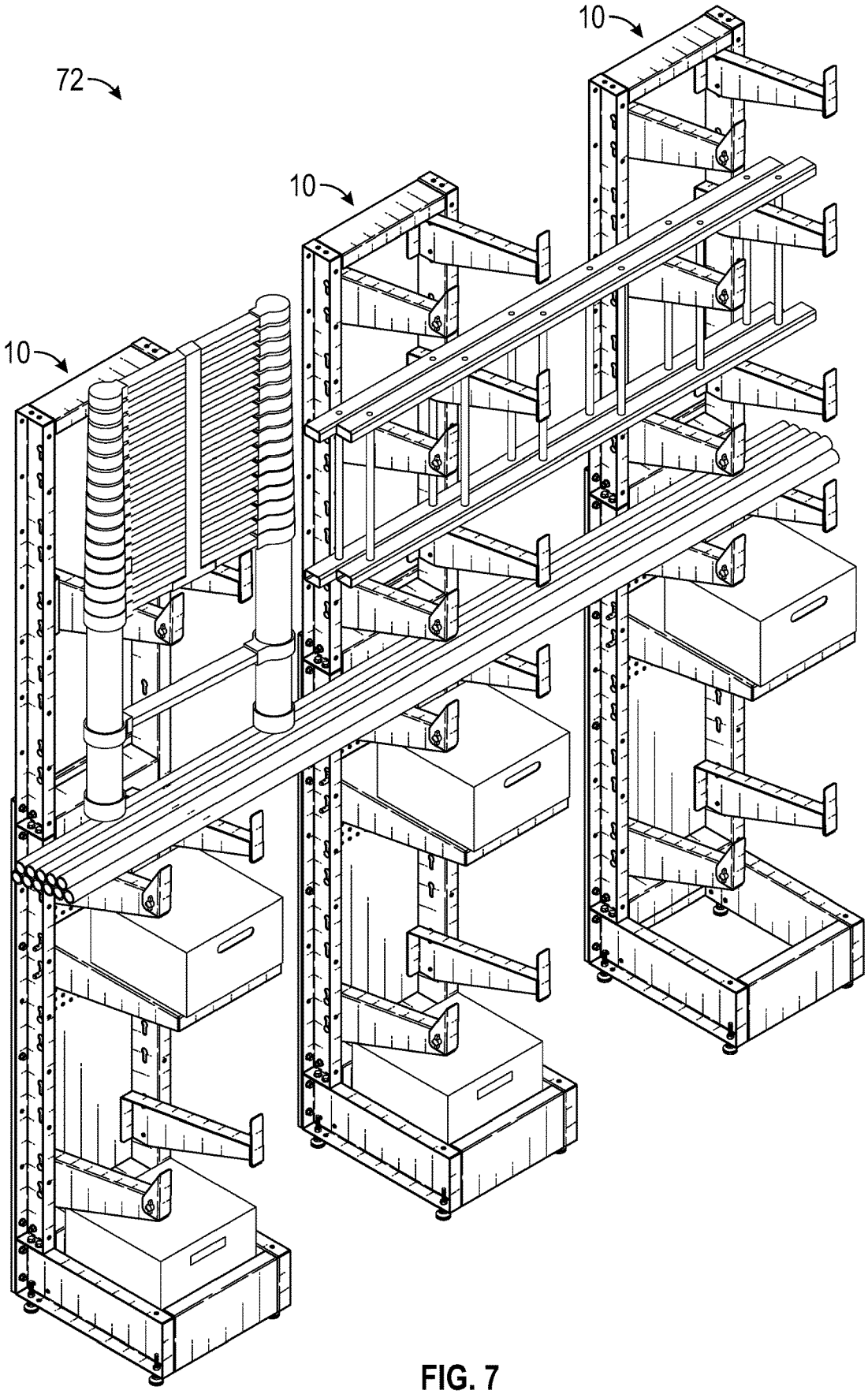

FIG. 7 illustrates a front perspective view of a series 72 of storage racks 10 holding, e.g., ladders, boxes, and piping. Each storage rack 10 of the series 72 is freestanding, wherein the rack 10 is not permanently, semi-permanently, or temporarily secured to a wall of the facility. Each storage rack 10 of the series 72 is also independent, such that the series of storage racks 72 do not have interlocking cross-pieces between the racks 10, nor are they needed to provide support to the series. Because of the freestanding capabilities of each storage rack 10, along with the lack of interlocking cross-pieces, each storage rack 10 of the series 72 may be portable to provide for a more convenient use of space within the facility when needed. Moreover, such portability provides adjustability in the overall length of the series of storage racks 72 to fit varying lengths, sizes, and kinds of objects to provide for optimal storage capacity. The arms 34 and at least one shelf 46 of each storage rack 10 in series 72 may be adjustable in height using the attachment mechanism 66 and series of keyhole slots 70 to fit varying lengths, sizes, and kinds of objects. The arms 34 of each storage rack 10 in series 72 may also be positioned at the same height to provide support to elongated objects stored across the series 72.

Figure 8:
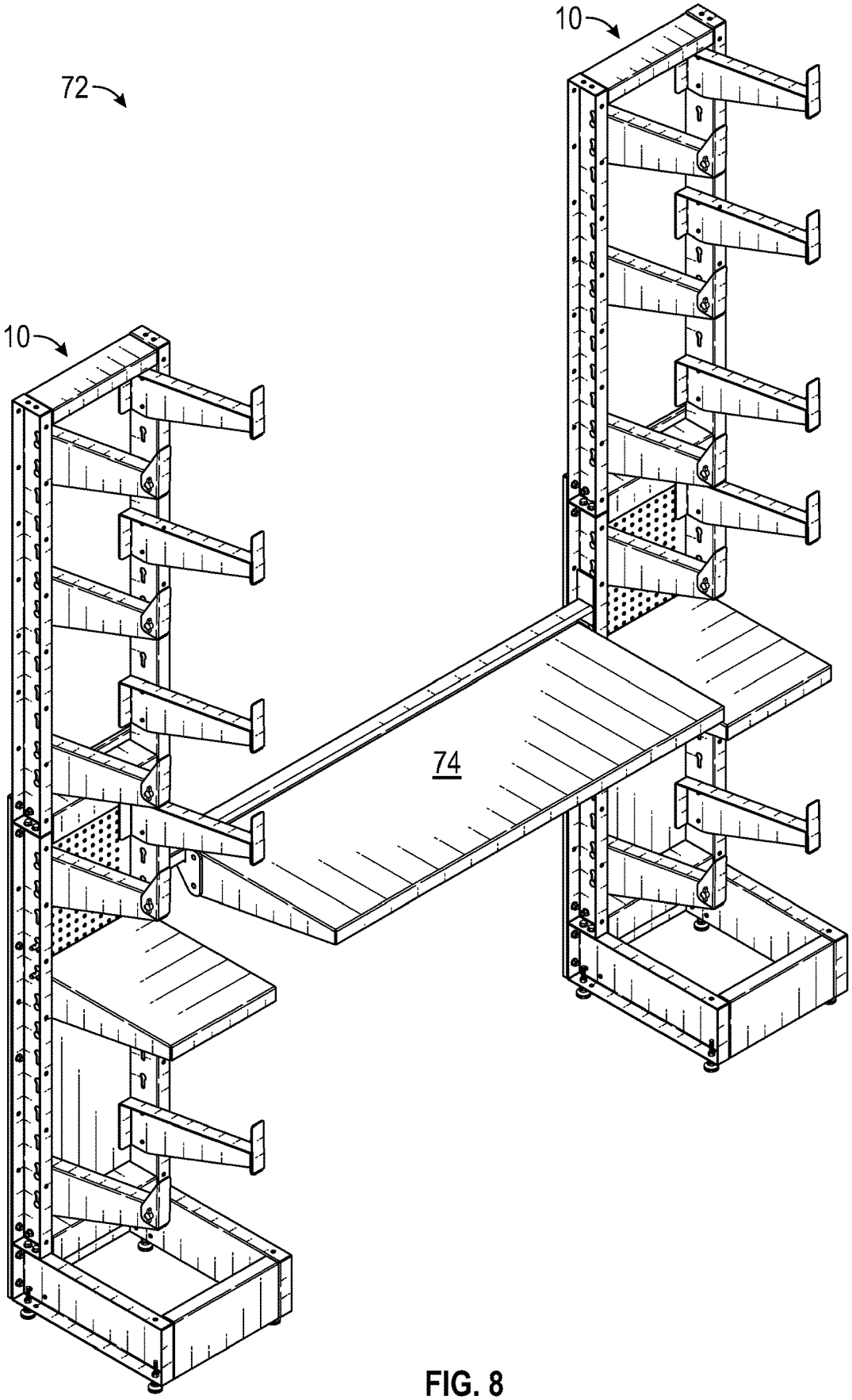

FIG. 8 illustrates a front perspective view of a series 72 of storage racks 10 comprising an optional, intermediate table 74 accessory. In particular, the table 74 may be removably secured to an exterior side of the left side and right side vertical members 28, 30 of two adjacent storage racks 10 in series 72. The table 74 may be removably secured to the left side and right side vertical members 28, 30 using at least one attachment mechanism 66 positioned on opposite ends of the table 74 and the series of keyhole slots 70 spaced equidistant along the length of the left side and right side vertical members 28, 30. The table 74 may be adjustable in height in relation to the storage racks 10 depending on the particular series of keyhole slots 70 utilized with the attachment mechanisms 66. The table 74 of the present disclosure may be used as a workbench or as additional storage space for the freestanding ladder storage rack 10 of the present disclosure to optimize storage capacity.

Another aspect of the present disclosure is a method of storing elongated objects, including but not limited to, ladders, lumber, and/or piping, using the storage rack 10 disclosed in FIGS. 1-8. In particular, the method may comprise providing the storage rack 10 and objects to be stored thereon. Next, the storage rack 10 may be placed adjacent to an interior wall of a facility without permanently, semi-permanently, or temporarily securing the device to the wall of the facility. Depending on the particular types of objects to be stored, additional storage racks 10 may be placed adjacent to the interior wall of the facility in series 72. The distance between each storage rack 10 in series 72 may be adjusted therebetween to account for storing varying lengths, sizes, and kinds of objects. If included, height adjustment knobs 24 on each storage rack 10 may be independently adjusted to level the storage rack 10 on uneven surfaces of the facility.

The method may next comprise adjusting the height of the arms 34 of each storage rack 10 in series 72 using the attachment mechanism 66 and series of keyhole slots 70 to further fit varying lengths, sizes, and kinds of objects. Additionally, the arms 34 of each storage rack 10 in series 72 may be positioned at a uniform height to provide support to elongated objects stored across the series 72. The shelves 46 of each storage rack 10 may be transitioned to the upright position 48 or the downward position 50 depending on particular objects to be stored by the device. Optionally, the table 74 may be removably secured to the left side and right side vertical members 28, 30 of adjacent storage racks 10 in series 72 using the at least one attachment mechanism 66 and the series of keyhole slots 70 to provide for a workbench or additional storage space. After the arms 34, shelves 46, and optional table 74 are removably secured to the storage racks 10 at their desired position, objects may be stored thereon. Objects may be further stored using the peg board 52 for mounting, storing and accessing tool accessories, along with the cubicle 22 of the base frame 12 for storing additional materials, such as but not limited to an open box or closed container for holding smaller objects. Thus, the method of using the storage rack 10 of the present disclosure provides for adjustability in length and height to fit varying lengths, sizes, and kinds of objects to provide for optimal storage capacity.

The freestanding ladder storage rack 10 and method of use of the present disclosure are universally applicable to ladders of all makes, manners and manufacturers. Furthermore, the storage rack 10 is designed to be inexpensive to manufacture, convenient to use, and comprised of lightweight and durable materials. Although the disclosure has been described and illustrated with respect to preferred aspects thereof, it is not to be so limited since changes, modifications, and combinations thereof may be made which are within the full intended scope of the disclosure.

What is claimed is:

1. A storage rack, comprising:

a base frame, comprising:

a) a front horizontal member;

b) a rear horizontal member;

c) a left side horizontal member;

d) a right side horizontal member;

e) a cubicle positioned therein;

a vertical frame, comprising:

a) a left side vertical member;

b) a right side vertical member;

c) a top horizontal member connecting the left side and right side vertical members;

the vertical frame being connected to the base frame to form a framework for the storage rack;

a plurality of arms designed to support objects thereon for storage purposes, each arm comprising:

a) a closed first end removably secured to either the left side or the right side vertical members of the vertical frame;

b) an open second end opposite the closed first end;

c) wherein the arm slopes downwardly from the open second end towards the closed first end removably secured to either the left side or the right side vertical members of the vertical frame;

d) the arm being adjustable in height along the left side or the right side vertical members of the vertical frame to fit varying lengths, sizes, and kinds of objects;

at least one shelf removably secured to the left side and right side vertical members of the vertical frame, the shelf transitional between an upright position and a downward position;

the storage rack being freestanding without securement to a wall of a facility;

the storage rack being used in series with at least one additional storage rack;

each storage rack of the series being independent wherein the series of storage racks do not have interlocking cross-pieces between the storage racks to provide support; and the series of storage racks being adjustable in length to fit varying lengths, sizes, and kinds of objects.

2. The storage rack of claim 1, the base frame further comprising:

at least four height adjustment knobs; and each height adjustment knob independently height adjustable for leveling the storage rack on uneven surfaces.

3. The storage rack of claim 1, further comprising:

a peg board attached to a rear of the base frame and vertical frame;

the peg board configured to provide support to the framework of the storage rack; and the peg board comprising a series of holes designed to accept hooks or hanging bins for storing objects.

4. The storage rack of claim 1, further comprising:

a fixed end cap rigidly secured to an open second end of the plurality of arms; and the fixed end cap designed to prevent an object from falling off the arm.

5. The storage rack of claim 1, further comprising:

an adjustable end cap rotatably coupled to an open second end of the plurality of arms; and the adjustable end cap designed to increase or decrease a stop angle;

the stop angle movable between:

a) a sharp incline to prevent an object from falling off the arm; and b) a reduced incline to provide for placement or removal of objects from the arm.

6. The storage rack of claim 1, further comprising:

at least one spacer;

the spacer designed for the arm to be removably secured to a first side of the spacer, wherein an opposite second side of the spacer is removably secured to the left side or right side vertical members of the vertical frame; and the spacer utilized to shorten a distance between a pair of arms removably secured to the vertical frame in parallel.

7. The storage rack of claim 6, further comprising:

a table;

the table removably secured to an exterior side of the left side and right side vertical members of two adjacent storage racks in series; and the table configured to act as a workbench or to provide additional storage space.

8. The storage rack of claim 7, further comprising:

a plurality of attachment mechanisms;

each attachment mechanism comprising a round pin having a head, a shank, and a shank end;

a series of keyhole slots spaced along a length of the left side and right side vertical members of the vertical frame;

the shank head designed to removably fit inside and rotatably lock within each keyhole slot of the series of keyhole slots;

the plurality of arms are removably secured to the left side or right side vertical members of the vertical frame using the plurality of attachment mechanisms and the series of keyhole slots;

the at least one shelf is removably secured to the left side and right side vertical members of the vertical frame using the plurality of attachment mechanisms and the series of keyhole slots; and the table is removably secured to an exterior side of the left side and right side vertical members of two adjacent storage racks in series using the plurality of attachment mechanisms and the series of keyhole slots.

9. The storage rack of claim 8, wherein the plurality of arms, at least one shelf, and table are adjustable in height using the plurality of attachment mechanisms and series of keyhole slots to fit varying lengths, sizes, and kinds of objects.

10. The storage rack of claim 1, wherein the arms of each storage rack in series are positional at the same height to provide support to elongated objects stored across the series.

11. A storage rack, comprising:

a base frame;

a vertical frame;

the vertical frame being connected to the base frame to form a framework for the storage rack;

a plurality of arms designed to support objects thereon for storage purposes, each arm comprising:

a) a closed first end removably secured to the vertical frame;

b) an open second end opposite the closed first end;

c) wherein the arm slopes downwardly from the open second end towards the closed first end;

d) the arm being adjustable in height along the vertical frame to fit varying lengths, sizes, and kinds of objects;

at least one shelf removably secured to the vertical frame, the shelf transitional between an upright position and a downward position;

the storage rack being freestanding without securement to a wall of a facility;

the storage rack being used in series with at least one additional storage rack;

each storage rack of the series being independent wherein the series of storage racks do not have interlocking cross-pieces between the storage racks to provide support; and the series of storage racks being adjustable in length to fit varying lengths, sizes, and kinds of objects.

12. The storage rack of claim 11, wherein the open second end of each arm comprises:

a fixed end cap rigidly secured to the open second end of the arm; or an adjustable end cap rotatably coupled to the open second end of the arm.

13. The storage rack of claim 12, further comprising:

the fixed end cap designed to prevent an object from falling off the arm; or the adjustable end cap designed to increase or decrease a stop angle;

the stop angle movable between:

c) a sharp incline to prevent an object from falling off the arm; and d) a reduced incline to provide for placement or removal of objects from the arm.

14. The storage rack of claim 11, further comprising:

at least one spacer;

the spacer designed for the arm to be removably secured to a first side of the spacer, wherein an opposite second side of the spacer is removably secured to the vertical frame; and the spacer utilized to shorten a distance between a pair of arms removably secured to the vertical frame in parallel.

15. The storage rack of claim 14, further comprising:

a table;

the table removably secured to the vertical frame of two adjacent storage racks in series; and the table configured to act as a workbench or to provide additional storage space.

16. The storage rack of claim 15, further comprising:

a plurality of attachment mechanisms;

a series of keyhole slots spaced along a length of the vertical frame;

each attachment mechanism designed to removably fit inside and rotatably lock within each keyhole slot of the series of keyhole slots;

the plurality of arms, at least one shelf, and table removably secured to the vertical frame using the plurality of attachment mechanisms and the series of keyhole slots; and the plurality of arms, at least one shelf, and table are adjustable in height using the plurality of attachment mechanisms and series of keyhole slots to fit varying lengths, sizes, and kinds of objects.

17. A method of storing objects, comprising:

providing the objects to be stored;

providing a storage rack, comprising:

a) a base frame;

b) a vertical frame;

c) the vertical frame being connected to the base frame to form a framework for the storage rack;

d) a plurality of arms designed to support objects thereon for storage purposes, each arm comprising:

i. a closed first end removably secured to the vertical frame;

ii. an open second end opposite the closed first end;

iii. wherein the arm slopes downwardly from the open second end towards the closed first end;

iv. the arm being adjustable in height along the vertical frame to fit varying lengths, sizes, and kinds of objects;

e) the storage rack being freestanding without securement to a wall of a facility;

placing the storage rack adjacent to an interior wall of a facility without permanently, semi-permanently, or temporarily securing the storage rack to the wall of the facility;

placing additional storage racks adjacent to the interior wall of the facility in series;

adjusting the distance between each storage rack in series;

adjusting the height of arms of each storage rack in series;

positioning arms of each storage rack at a uniform height to provide support to objects stored across the series of storage racks; and storing the objects on the arms of the storage racks in series.

18. The method of claim 17, further comprising at least one of the following steps:

providing at least one shelf removably secured to the vertical frame, the shelf transitional between an upright position and a downward position;

providing a table, the table removably secured to the vertical frame of two adjacent storage racks in series;

wherein the at least one shelf and table are configured to provide additional storage space to the storage racks in series.

* * * * *